United States Patent [19]

Werjefelt

[11] Patent Number: 5,062,229

[45] Date of Patent: Nov. 5, 1991

[54] POSTCARD CALENDAR

[76] Inventor: Christina Werjefelt, 277 Kaha St., Kailua, Hi. 96734

[21] Appl. No.: 464,398

[22] Filed: Jan. 12, 1990

[51] Int. Cl.[5] ..... B42D 5/04; B42D 15/00

[52] U.S. Cl. ..... 40/107; 40/119; 40/121; 40/120

[58] Field of Search ..... 40/119, 120, 121, 154, 40/156, 107; 283/2, 3

*Primary Examiner*—Kenneth J. Dorner
*Assistant Examiner*—Cassandra L. Hope
*Attorney, Agent, or Firm*—Shlesinger, Arkwright & Garvey

[57] ABSTRACT

A calendar comprises a plurality of sheets superimposed on each other and a binder for hinging each of the sheets along one edge such that each may be rotated at least through half a circle to thereby expose the next succeeding sheet. Each of the sheets includes a demarcation line disposed across thereof for dividing each of the sheets into a first portion adjacent the binder and a second portion away from the binder for permitting the second portion to be completely separated from the first portion through the demarcation line such that when the second portion is detached from the first portion, the first portion remains attached to the binder and a second portion of a succeeding sheet is exposed. The first portion includes a front surface having normally right-side-up calendar indicia for a complete unit of time and a rear surface having non-calendar indicia. The second portion includes a front surface having printed graphic art indicia and a rear surface having postcard indicia.

1 Claim, 2 Drawing Sheets

FIG. 3
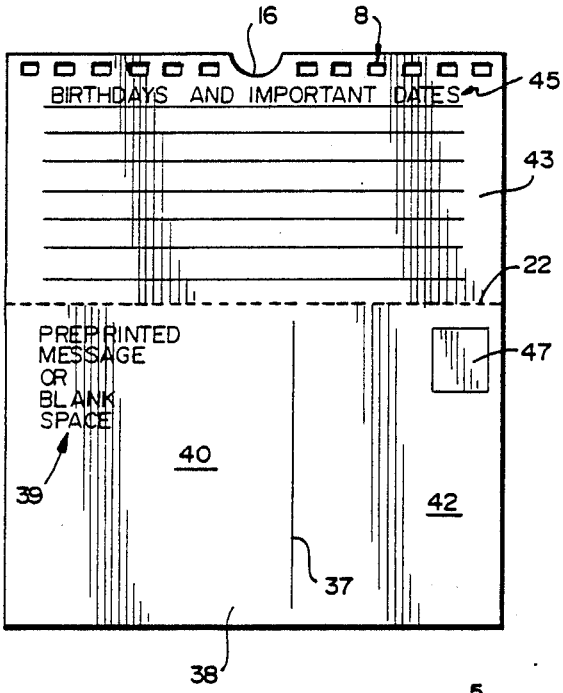
FIG. 4
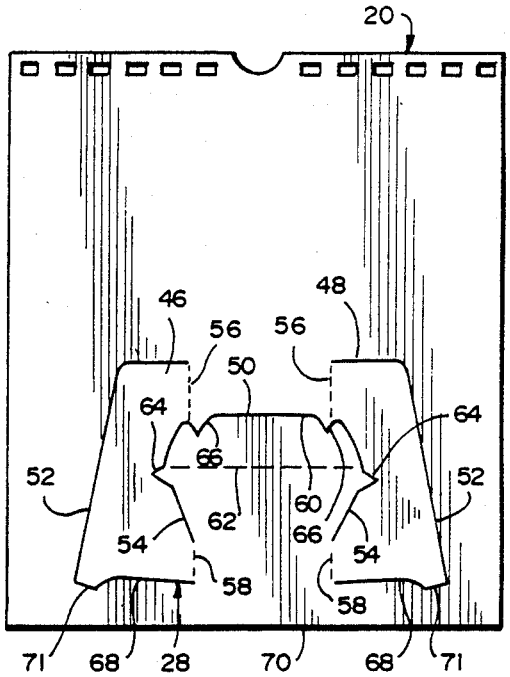
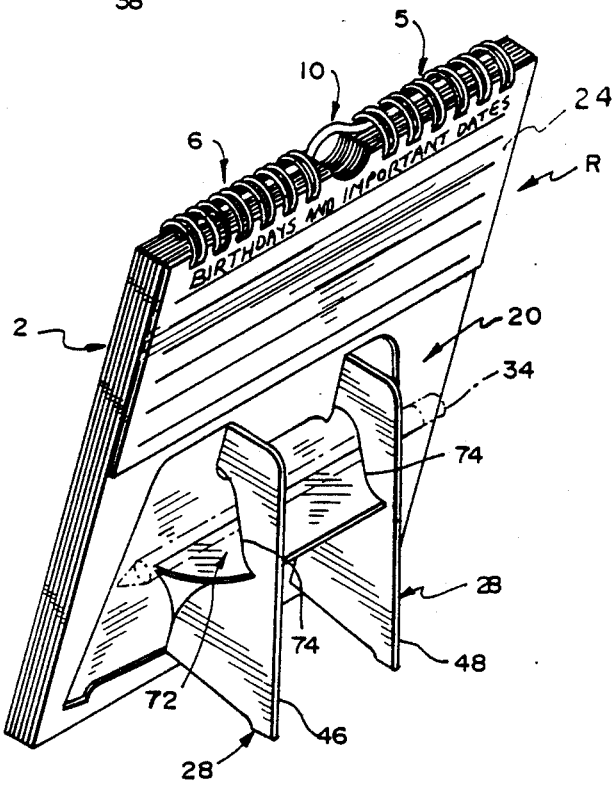
FIG. 5

POSTCARD CALENDAR

FIELD OF THE INVENTION

The present invention relates generally to a calendar, and in particular to a postcard calendar.

BACKGROUND OF THE INVENTION

Calendars are normally printed with graphic art, such as drawings, messages or pictures of nature, people, animals, or objects for providing a pleasing appearance to the user when he or she looks at the calendar. This is typically done by allocating a certain portion of each sheet of the calendar or dedicating a separate sheet for printing the graphic art. When a calendar expires, it is normally discarded, along with the portions bearing the printed graphic art, since they are usually integral to the calendar. It is usually inconvenient to separate the graphic art portion of the calendar before discarding the calendar. Thus, waste occurs due to the lack of a convenient way of reusing the printed graphic art portions of the calendar.

Calendars with removable postcards having printed graphic art or messages are an attempt to solve the above problem. Examples of prior art directed to this type of calendars are discussed below.

U.S. Pat. No. 4,757,624 issued to Holec, discloses a calendar comprising a plurality of sheets hinged along one edge. Each sheet comprises spaced removable postcards with one part a month printed on one side of a sheet adjacent one edge and another part of a month printed on the other side of the sheet adjacent the edge. However, Holec does not display a calendar having a complete unit of time on a single side of a sheet. Holec needs two sheets to show one month. Further, a portion of the succeeding month is printed on the obverse side of the calendar so that the front and back of the calendar portions are back-to-back. Also, the graphic art on the postcards disposed below the calendar portion is not visible in the upright non-inverted position; instead, the postcard indicia are shown. Note that when the calendar of Holec is inverted, the graphic art on the postcards is upside down as is the calendar indicia.

U.S. Pat. No. 2,263,528 issued to Wissman shows a calendar having a series of leaflets detachably connected to a binder. Each leaflet includes a top portion having a removable postcard and lower portion having a calendar. The upper portion includes a border of weakened lines to permit removable of the postcard therefrom. The border forms a frame for the next picture thereunder when the postcard is removed. The lower portion may be separated from the top portion along a scored line when the calendar month on the leaflet expires. The calendar month portion is not designed to remain attached to the binder when it expires.

U.S. Pat. No. 1,169,738 issued to Smiley shows a correspondence reminder having a calendar in the top portion and a postcard in the lower portion. The postcard indicia is shown on the same face with the calendar information. The postcard is separated from the top portion by line of scoring. Smiley does not show graphic art indicia on the front face of the postcard nor does it disclose graphic art on the back side of the postcard.

OBJECTS AND SUMMARY OF THE INVENTION

It is therefore an object of the present invention to provide a calendar having a portion with printed graphic art which can be easily separated from the calendar portion and reused, thereby preventing waste.

It is another object of the present invention to provide a calendar with a plurality of bound sheets, each of which includes a calendar portion and a postcard portion, wherein each postcard portion can be relatively easily separated from its respective calendar portion while leaving all the calendar portions bound together.

It is still another object of the present invention to provide an attractive postcard calendar having a calendar portion and a graphic art postcard portion where the calendar portion is simultaneously visible with the graphic art during normal use with means to hide the postcard indicia from sight. This indicia is printed on the backside of the postcard portion.

It is a further object of the present invention to provide a postcard calendar having a plurality of sheets wherein each sheet shows a complete unit of time.

It is yet another object of the present invention to provide a postcard calendar which can be positioned on a desktop or any other horizontal surface.

It is an object of the present invention to provide a post card calendar which has an integral and locking foldout stand for securely positioning the calendar on a desktop or any horizontal surface.

It is yet another object of the present invention to provide a postcard calendar which can be hung from a wall or any vertical surface.

It is another of the present invention to provide a postcard calendar which is attractive and pleasing to the eyes in which each separate time unit may be presented on a single sheet.

In summary, the present invention provides a postcard calendar having separable postcard portions with printed graphic art indicia visible during normal use for a pleasing appearance and the removable of which permits the calendar portion to remain bound together.

These and other objects of the present invention will become apparent from the following detailed description.

BRIEF DESCRIPTIONS OF THE DRAWINGS

FIG. 3 shows a rear surface of one of the sheets of the calendar of FIG. 1.

Figure 1:
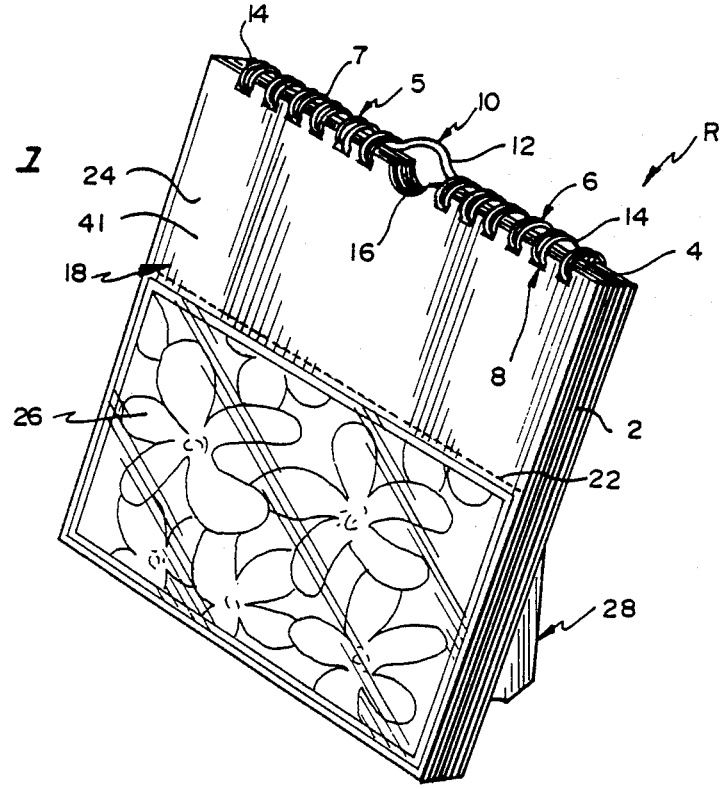
FIG. 1 shows a front perspective view of a calendar according to the present invention in an erected position.

FIG. 4 a rear view of the back cover of the calendar of FIG. 1 showing an outline of a fold-out stand in the unfolded position.

FIG. 5 is a rear perspective view of the calendar of FIG. 1, showing the fold-out stand of FIG. 4 in a deployed folded out position.

DETAILED DESCRIPTION OF THE INVENTION

FIG. 1

A postcard calendar R according to the present invention is disclosed in FIG. 1. The calendar R includes a plurality of sheets 2 superimposed on each other and joined together at their upper edges 4 by binders 5 and 6 cooperating with a plurality of holes 8 disposed adjacent the sheet upper edges 4. The binders 5 and 6 include a plurality of rings 7 operably associated with the holes 8. The rings 7 are preferably connected to each other. A member 10 having a bent portion 12 and straight end portions 14 is pivotally secured between each of the binders 5 and 6 such that the bent portion 12 is disposed opposite a notch 16 on a center portion of each top edge 4 of the sheets 2. The binders 5 and 6 are each disposed on respective end portions of the upper edges 4. The plurality of sheets 2 includes a cover sheet 18 and a stiff back cover 20, as best shown in FIGS. 1 and 4.

A demarcation or perforated line 22 runs across each of the sheets 2 for dividing each sheet into an upper portion 24 and a lower portion 26. A fold out stand 28 integral with the back cover 20 provides a means for positioning the calendar R in a substantially vertical position on any horizontal surface, such as a desk top (not shown).

FIGS. 2 AND 3

Figure 2:
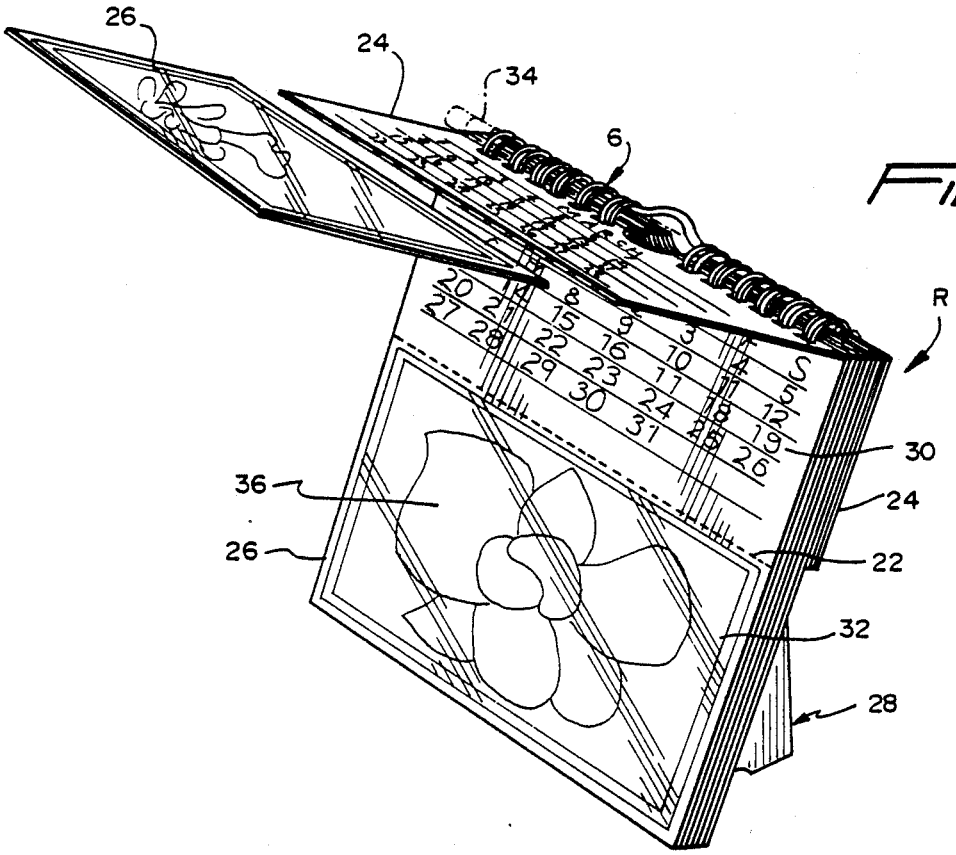
FIG. 2 shows the calendar of FIG. 1 with a sheet lifted up and a lower portion thereof separated therefrom.

The upper portion 24 has calendar indicia 30 for a complete unit of time, such day, week, month, quarter, or year. The lower portion 26 has graphic art indicia 32, such as cartoons, drawings, messages or pictures of flowers, bays, mountains, natural sceneries, people engaged in sports, girls, boys, other objects, etc. The lower portion 26 is a standard postcard which can be readily completely separated from the upper portion 24 by cutting or tearing along the demarcation or perforated line 22, as best shown in FIG. 2, where the postcard portion 26 is shown detached from the upper portion 24. The calendar indicia 30 and/or the graphic art indicia 32 may be printed with fluorescent ink, as desired. The calendar indicia 32 is normally right-side-up during use. The sheets 2 are preferably made from suitable paper products such that the postcard portion 26 will withstand the normal wear and tear in the mail.

The binders 5 and 6 allow the sheets 2 to be swung towards the back through a substantially full circle from the front to the back. The binders 5 and 6 form a longitudinal pocket which is adapted to receive a pencil 34, shown in dashed lines or any longitudinal writing instrument.

The lower portion 26 includes a front surface 36 and a rear surface 38, as best shown in FIG. 3. The front surface 36 provides an area for printing the graphic art indicia 32. The rear surface 38 includes a postcard indicia comprising a printed vertical line 37 and a printed rectangle 47. The line 37 divides the rear surface 38 into a space 40 for writing massages and a space 42 for addressing the postcard and for affixing a stamp. The space 40 can include preprinted messages 39 as is normally found in greeting cards, thus providing more convenience to the user.

The upper portion 24 includes a front surface 41 and rear surface 43, as best shown in FIGS. 1 and 3. The front surface 41 provides a printing area for the calendar indicia 30. The rear surface 43 includes printed indicia 45, such as ruled spaces to indicate to the user a convenient place for writing down important dates, notes, etc.

The calendar R may be rotated about an imaginary vertical axis so that the rear surfaces 38 and 43 may be viewed right-side-up after a sheet 2 has been turned substantially a full circle about the binders 5 and 6.

FIGS. 4 AND 5

The stiff back cover 20 includes the integral fold-out stand 28. The fold-out stand 28 includes vertical members 46 and 48, each of which is a mirror image of the other and horizontally spaced apart from each other. The fold-out stand 28 also includes a horizontal member 50 disposed between the intermediate portions of the vertical members 46 and 48. The vertical members 46 and 48 are spaced from each other. Each of the vertical members 46 and 48 is bounded by cut lines 52 and 54 and hinge lines 56 and 58. Hinge lines 56 and 58 form a straight line for ease of bending therealong. The horizontal member 50 is bounded by cut line 60 and hinge line 62. Portions of cut lines 60 are common with portions of cut lines 54, as best shown in FIG. 4. Perforations, half cut, compression or other standard means may be used to produce the hinge lines 56, 58 and 62.

The vertical members 46 and 48 each includes a notch 64 disposed along its inner intermediate portion which locks with a respective notch 66 disposed at each end portion of the horizontal member 50 such that when the vertical members 46 and 48 are folded along hinge lines 56 and 58 and the horizontal member along hinge line 62 to substantially transverse positions relative to the back cover 20, the vertical members 46 and 48 will lock with the horizontal member 50 to insure that the fold-out stand 28 remain in the deployed position, as best shown in FIG. 5. The fold-out stand 28 is disposed below the demarcation or perforated line 22 such that any of the sheets 2 when flipped to the rear after each lower portion 26 has been detached will not interfere with the fold-out stand 28. The vertical members 46 and 48 have lower edge portions 68 which are spaced from the lower edge 70 of the back cover 20. In this manner, when the fold-out stand 28 is deployed into its folded out position, the calendar R will make an acute angle with the horizontal surface on which it is standing, as best shown in FIGS. 1, 2 and 5. The calendar R will thus be positioned slightly off from the vertical for a more natural reading position. The vertical members 46 and 48 each includes a corner edge portion 71 which makes a slight angle with the horizontal such that when the fold-out stand 28 is deployed, each of the edge portions 71 will be parallel to the horizontal surface on which the calendar R is positioned.

The horizontal member 50, when deployed in the folded out transverse position forms a shelf 72 with stop means 74 provided by the vertical members 46 and 48 for providing a holder a pencil 34 or other writing instruments.

OPERATION

To position the calendar R on a desk top, the integral fold-out stand 28 is folded out and deployed from its flush position with the back cover 20 to its folded out locked position, as best shown in FIGS. 4 and 5. The vertical members 46 and 48 are separated from the back cover 20 along cut lines 52 and 54 and folded substantially transversely along hinge lines 56 and 58. Likewise, the horizontal member 50 is separated from the back cover 20 along cut line 60 and folded substantially transversely along hinge line 62. The respective notches 64 and 66 are locked together, thereby locking the fold-out stand 28 in its folded out and deployed position, as best shown in FIG. 5.

The calendar R can also be hung by securing the bent portion 12 to a supporting means (not shown) disposed on a wall or any suitable hanging structure. The fold-out stand 28 is preferably flush with the back cover 20 when hanging against a wall.

The calendar R during use can also be laid flat on a horizontal surface, such as a desktop, instead of using the fold-out stand 28. In this manner of use, the fold-out stand 28 remains flush with the back cover 20.

During use, a user can separate the lower portion 26 of the front cover sheet 18 by carefully tearing or cutting along the demarcation or perforation line 22. The upper portion is then swung over along the binders 5 and 6 until it rests against the back cover 20. The sheet 2 having the calendar indicia 30 of the upper portion will now be visible. At any time during the year, the user can tear off the postcard lower portions 26 until they have all been used up. The upper portion 24 bearing the calendar indicia 30 will simply remain affixed to the binders 5 and 6, ready to be turned over when it expires. Expired calendars may be reviewed anytime by simply rotating the upper portions 24 back to the front.

The user can use the space 40 at the rear surface 38 of the lower portion for any messages for the addressee. For the convenience of the user, the preprinted message 39, such as a greeting message, if provided, may be used as is or augmented by the user.

The user can use the rear surface 43 of the upper portion 24 for writing down important date, notes or other messages. Since the upper portion 24 remains affixed to the binders 5 and 6, the user can refer to the messages during the year.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention or the limits of the appended claims.

I claim:

1. A calendar, comprising:

a) a plurality of sheets superimposed on each other, each of said sheets having front and rear faces and a top edge;

b) means for hingeably binding said plurality of sheets along said top edges such that each of said sheets may be rotated in planar position about said binding means through substantially a full circle to thereby expose said front face of a next succeeding sheet and said rear face of the sheet being turned when said calendar is rotated about an imaginary vertical axis;

c) each of said sheets including a straight demarcation line disposed across thereof from one side to the opposite side;

d) each of said sheets including a first portion adjacent said binding means and a second portion disposed away from said binding means and separated by said demarcation line;

e) said second portion being detachable from said first portion through said demarcation line such that when said second portion is detached from said first portion, said first portion remains attached to said binding means and a second portion of a succeeding sheet is exposed;

f) said first portion including a front surface having right-side-up calendar indicia relative to said top edge for a complete unit of time and a rear surface having non-calendar indicia and blank ruled spaces for receiving written notes;

g) said second portion including a front surface having printed graphic art indicia and a rear surface having a blank postcard indicia, said graphic art indicia being right-side-up when said calendar indicia is oriented right-side-up, said second portion rear surface including a blank space for receiving an address and another blank space for receiving a written message;

h) each of said top edges including a notch disposed on an intermediate portion thereof;

i) a member pivotally secured to said binding means for permitting the calendar to be hung from a wall;

j) said member including a curved portion disposed opposite said notch;

k) a back cover secured to said plurality of sheets, said back cover being of the same size as each of said sheets;

l) a fold-out stand integral with said back cover for providing support to the calendar when positioned substantially vertically on a horizontal surface; and m) said stand being completely disposed below said demarcation line such that said upper portion, when rotated substantially a full circle about said binding means after its respective lower portion has been detached, does not interfere with said stand.

* * * * *